US008667872B2

(12) United States Patent
McCullough et al.

(10) Patent No.: US 8,667,872 B2
(45) Date of Patent: Mar. 11, 2014

(54) SOCKET HOLDER

(76) Inventors: Nicholas McCullough, Fairburn, GA (US); Edward Cigallio, Douglasville, GA (US)

( * ) Notice: Subject to any disclaimer, the term of this patent is extended or adjusted under 35 U.S.C. 154(b) by 267 days.

(21) Appl. No.: 13/272,150

(22) Filed: Oct. 12, 2011

(65) Prior Publication Data

US 2012/0096993 A1 Apr. 26, 2012

Related U.S. Application Data

(60) Provisional application No. 61/406,925, filed on Oct. 26, 2010.

(51) Int. Cl.
*B25B 13/06* (2006.01)
*B25B 23/00* (2006.01)

(52) U.S. Cl.
CPC ..... *B25B 23/00* (2013.01); *B25B 23/0021* (2013.01); *B25B 23/0035* (2013.01)
USPC ..... 81/177.2; 81/177.85

(58) Field of Classification Search
USPC ..... 81/177.2, 177.85; D8/29
See application file for complete search history.

(56) References Cited

U.S. PATENT DOCUMENTS

| | | | | | |
|---|---|---|---|---|---|
| 1,523,022 | A * | 1/1925 | Larson | 81/124.6 |
| 2,718,806 | A * | 9/1955 | Clark | 81/125 |
| 2,896,985 | A * | 7/1959 | Braatz | 403/328 |
| 3,172,675 | A * | 3/1965 | Gonzalez | 279/2.23 |
| 3,227,015 | A * | 1/1966 | Tremblay | 81/177.2 |
| 3,452,373 | A * | 7/1969 | Vosbikian et al. | 7/138 |
| 5,168,782 | A * | 12/1992 | Cromwell | 81/177.2 |
| 5,752,418 | A * | 5/1998 | Robins | 81/177.2 |
| 5,943,924 | A * | 8/1999 | Jarvis | 81/177.2 |
| 8,220,366 | B1 * | 7/2012 | Fierro et al. | 81/177.85 |
| 2005/0160882 | A1 * | 7/2005 | Crow | 81/177.2 |

* cited by examiner

*Primary Examiner* — David B Thomas
(74) *Attorney, Agent, or Firm* — Withers & Keys, LLC

(57) ABSTRACT

A socket holder may be designed as part of a socket extension or built into a socket holding end of a ratchet. The socket holder may have a mechanism to hold the socket at a conventional position. However, unlike conventional socket holders, the present invention may allow the socket to push past the holding mechanism, allowing the socket holder to fill an inside of the socket and provide pressure on the head of the bolt being applied by the socket. A magnet may be disposed on the end of the socket holder facing the bolt to help secure the bolt within the socket holder.

19 Claims, 3 Drawing Sheets

SOCKET HOLDER

CROSS-REFERENCE TO RELATED APPLICATIONS

This application claims the benefit of priority to U.S. Provisional patent application No. 61/406,925, filed Oct. 26, 2010, the contents of which are herein incorporated by reference.

BACKGROUND OF THE INVENTION

The present invention related to a socket holder and, more particularly, to a socket holder that provides an axial force on a bolt while the bolt is tightened with a socket.

Referring to FIGS. 1 through 3, a conventional socket extension 100 may include a socket retention end 102 and a ratchet fitting end 104. A socket 106 may fit onto the socket retention end 102 and may be held in place with a spring-loaded ball 108 that fits into an indentation 110 of the socket 106. The socket 106, especially if the socket 106 is a deep well socket, may permit a bolt 112 to fit entirely within the socket 106, as shown in FIG. 3. This may make it difficult to start the bolt 112 onto a nut or threaded hole. Furthermore, this may cause the bolt to sag, resulting in misalignment of the bolt 112 on the nut. Finally, the conventional design does not allow a user to place axial pressure on the bolt, especially when the bolt is shorter than the interior of the socket.

As can be seen, there is a need for an improved socket holder that may overcome many of the deficiencies of the conventional socket holders and socket extensions.

SUMMARY OF THE INVENTION

In one aspect of the present invention, a socket holder comprises a socket retention end adapted to hold a socket; at least one spring resiliently protruding from at least a portion of the socket retention end of the socket holder, the at least one spring adapted to frictionally engage the socket when the socked is slid along the socket retention end; and a magnet disposed on an end of the socket retention end of the socket holder, wherein the socket is slidable along the socket retention end, providing a variable socket depth inside the socket.

In another aspect of the present invention, a socket holder comprises a socket retention end adapted to hold a socket, wherein the socket is slidable along the socket retention end, providing a variable socket depth inside the socket.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an exemplary embodiment of the present invention provides a socket holder which may be part of a socket extension or built into a socket holding end of a ratchet. The socket holder may have a ball or spring to hold the socket at a conventional position. Unlike prior art socket holders, the present invention may allow the socket to push past the ball, allowing the socket holder to fill an inside of the socket and provide pressure on the head of the bolt being applied by the socket. A magnet may be disposed on the end of the socket holder facing the bolt to help secure the bolt within the socket holder.

Figure 1:
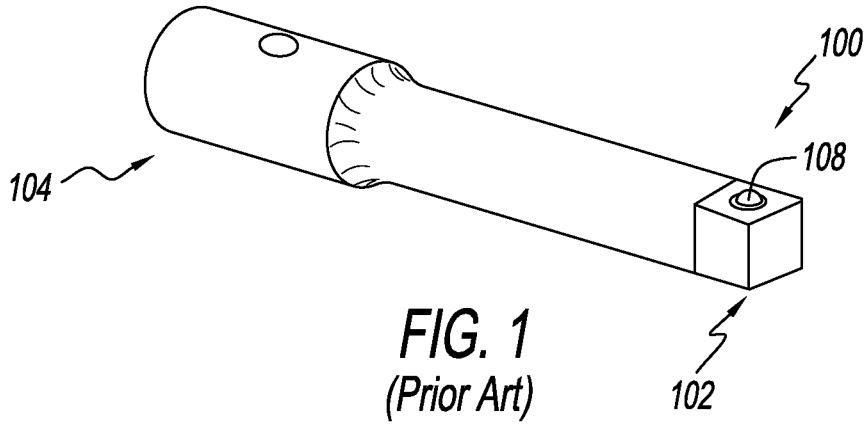
FIG. 1 (Prior Art)
FIG. 1 shows a perspective view of a socket extension according to the prior art.
Figure 2:
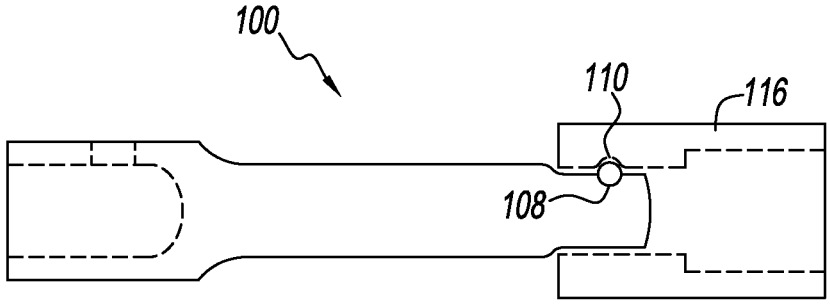
FIG. 2 (Prior Art)
FIG. 2 shows a side view of the prior art socket extension of FIG. 1 with a socket attached.
Figure 3:
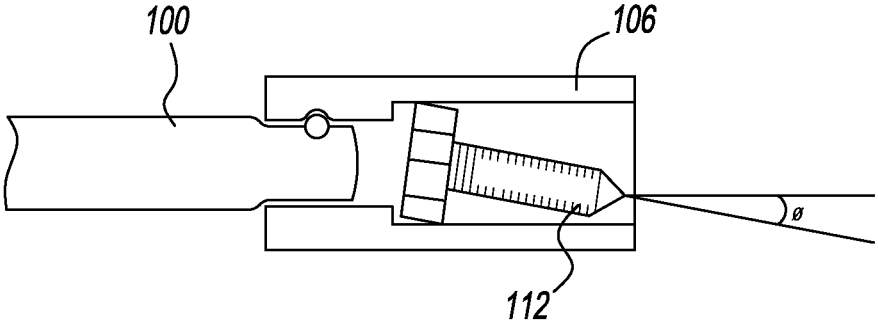
FIG. 3 (Prior Art)
FIG. 3 shows a side view of the prior art socket extension/socket of FIG. 2 showing the potential for bold misalignment.
Figure 4:
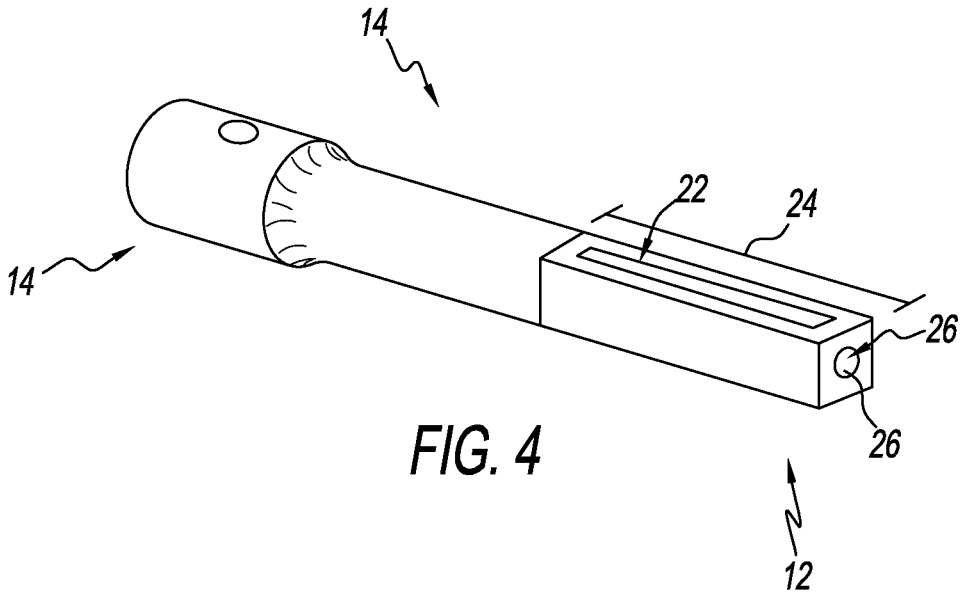
FIG. 4 shows a socket holder in the form of a socket extension, according to an embodiment of the present invention.
Figure 5:
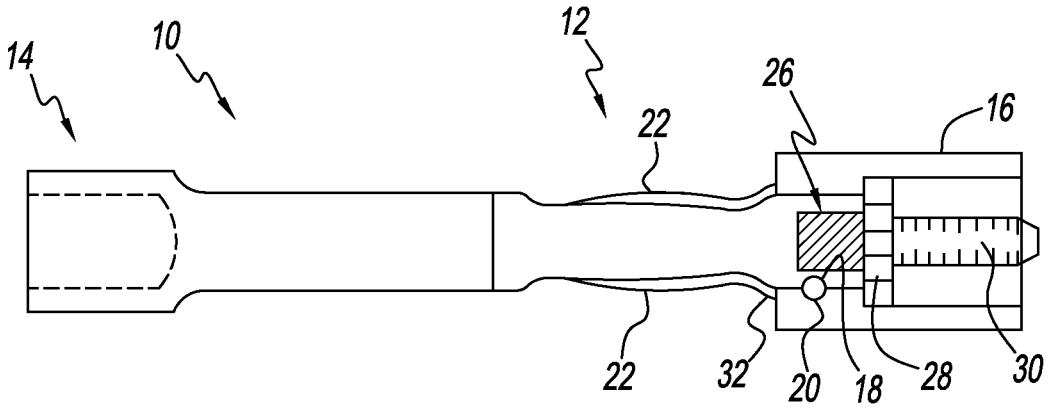
FIG. 5 shows a side view of the socket holder of FIG. 4 with a socket attached.
Figure 6:
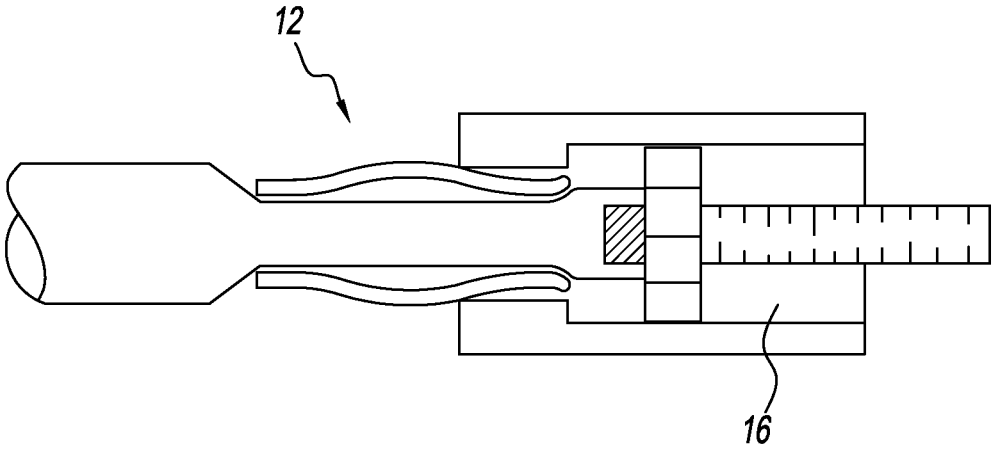
FIG. 6 shows a close-up view of the socket holder/socket of FIG. 5.

Referring to FIGS. 4 through 6, a socket holder, for example, a socket extension 10 may include a socket retention end 12 and a ratchet fitting end 14. A socket 16 may fit onto the socket retention end 12 and may be held in place with a spring-loaded ball 18 that fits into an indentation 20 of the socket 16. In an alternate embodiment, ends 32 of at least one spring 22 may hold the socket 16 in place at a conventional location on the socket retention end 12. The socket retention end 12 may include at least one flat spring 22 that may resiliently protrude from the plane of at least one side of the socket retention end 12. The socket 16 may be pressed into the socket retention end 12 beyond the spring-loaded ball 18, as shown in FIG. 6. The spring 22 may provide pressure on the socket 16 to prevent the socket 16 from freely sliding along a length 24 of the socket retention end 12. In some embodiments, two springs 22 are disposed on opposite sides of the socket retention end 12. In some embodiments, one spring 22 is disposed on each side of the socket retention end 12 (four springs 22 in total). The spring 22 (or springs) can both hold the socket 16 in position or provide sliding tension for the socket 16, with or without the spring loaded ball 18.

A magnet 26 may be disposed on an end of the socket retention end 12. The magnet 26 may secure a bolt head 28 of a bolt 30, as shown in FIGS. 5 and 6.

The socket retention end 12 may have a length 24 from about 1 to about 5 inches, typically about 2 inches. The length 24 of the socket retention end 12 may be designed so that when the socket 16 is fully pushed onto the socket retention end 12 (disposed as close as possible to the ratchet fitting end 14), the inside of the socket 16 may have enough room to engage the bolt head 28.

The socket retention end 12, although shown as part of a socket extension 10, may be formed directly on a ratchet head or a driving device. When part of a socket extension 10, the extension may be made in various lengths, from about 3 inches to about 12 inches. The socket retention end 12 and the ratchet fitting end 14 may be typical socket sizes. For example, the socket retention end 12 and the ratchet fitting end 14 may be ⅜ inch square, ½ inch square, ¾ inch square or the like. The size of the socket retention end 12 and the ratchet fitting end 14 may be the same or different.

To use the device of the present invention, a user may insert the bolt head 28 into the socket 16 and adjust the position of the socket 16 on the socket retention end 12 so that at least a portion of the threads of the bolt 30 extend beyond the socket. (See FIG. 6) In this position, a user may, with one hand, position the bolt on a nut (or some other threaded opening) and install the bolt 30 while applying an axial force onto the bolt head 28.

The device of the present invention may satisfy several needs. The design may retain the bolt for hands-free operation as well as vertical and horizontal assembly, where gravity would cause bolt/socket/part misalignment. The design may allow access to otherwise inaccessible areas for mechanical repairs or assembly. The design may allow duplicity of use with standard sockets as well as deep well sockets. The design can eliminate the need for two socket sets (standard and deep well), as only deep well sets are needed. Finally, the design may allow the mechanic to apply an axial load to the axis of the fastener, aiding in parts alignment and assembly.

It should be understood, of course, that the foregoing relates to exemplary embodiments of the invention and that modifications may be made without departing from the spirit and scope of the invention as set forth in the following claims.

What is claimed is:

1. A socket holder comprising:

a socket retention end adapted to hold a socket, and at least one spring resiliently protruding from at least a portion of the socket retention end of the socket holder, the at least one spring adapted to frictionally engage the socket, wherein the socket is slidable along the socket retention end, providing a variable socket depth inside the socket.

2. The socket holder of claim 1, further comprising a spring loaded ball disposed in the socket retention end, the ball adapted to fit into an indentation in the socket to retain the socket with a fixed socket depth.

3. The socket holder of claim 1, wherein an end of the at least one spring is adapted to retain the socket with a fixed socket depth.

4. The socket holder of claim 1, wherein the at least one spring is two springs resiliently protruding from opposite sides of the socket retention end.

5. The socket holder of claim 1, wherein the spring is a flat spring.

6. The socket holder of claim 1, further comprising a magnet disposed on an end of the socket retention end of the socket holder.

7. The socket holder of claim 1, further comprising an attachment end, the attachment end adapted to fit onto a ratchet or a driving device.

8. The socket holder of claim 1, wherein the socket holder is an integral component of a ratchet or a driving device.

9. A socket holder comprising:

a socket retention end adapted to hold a socket:

at least one spring resiliently protruding from at least a portion of the socket retention end of the socket holder, the at least one spring adapted to frictionally engage the socket when the socked is slid along the socket retention end; and a magnet disposed on an end of the socket retention end of the socket holder, wherein the socket is slidable along the socket retention end, providing a variable socket depth inside the socket.

10. The socket holder of claim 9, further comprising a spring loaded ball disposed in the socket retention end, the ball adapted to fit into an indentation in the socket to retain the socket with a fixed socket depth.

11. The socket holder of claim 9, wherein an end of the at least one spring is adapted to retain the socket with a fixed socket depth.

12. The socket holder of claim 9, wherein the at least one spring is two springs resiliently protruding from opposite sides of the socket retention end.

13. The socket holder of claim 9, wherein the spring is a flat spring.

14. The socket holder of claim 9, further comprising an attachment end, the attachment end adapted to fit onto a ratchet.

15. The socket holder of claim 9, wherein the socket holder is an integral component of a ratchet.

16. A socket holder comprising:

a socket retention end adapted to hold a socket;

an attachment end opposite the socket retention end, the attachment end adapted to fit onto a ratchet or a driving device; and at least one spring resiliently protruding from at least a portion of the socket retention end of the socket holder, the at least one spring adapted to frictionally engage the socket;

wherein the socket is slidable along the socket retention end, providing a variable socket depth inside the socket.

17. The socket holder of claim 16, further comprising a spring loaded ball disposed in the socket retention end, the ball adapted to fit into an indentation in the socket to retain the socket with a fixed socket depth.

18. The socket holder of claim 16, wherein the at least one spring is two springs resiliently protruding from opposite sides of the socket retention end.

19. The socket holder of claim 18, wherein each spring is a flat spring.

* * * * *